US005928555A

United States Patent [19]

Kim et al.

[11] Patent Number: 5,928,555

[45] Date of Patent: Jul. 27, 1999

[54] MICROWAVE FOOD SCORCH SHIELDING

[75] Inventors: Young Hwa Kim; Hong Ji, both of Woodbury; Victor Karpov, Inver Grove Heights, all of Minn.

[73] Assignee: General Mills, Inc., Minneapolis, Minn.

[21] Appl. No.: 09/009,349

[22] Filed: Jan. 20, 1998

[51] Int. Cl.[6] ..... H05B 6/80

[52] U.S. Cl. ..... 219/729; 219/728; 426/234; 99/DIG. 14

[58] Field of Search ..... 219/728, 729, 219/730; 426/107, 109, 234, 241, 243; 99/DIG. 14

[56] References Cited

U.S. PATENT DOCUMENTS

| | | | |
|---|---|---|---|
| 4,144,438 | 3/1979 | Gelman et al. | 219/728 |
| 4,228,334 | 10/1980 | Clark et al. | 219/728 |
| 4,268,738 | 5/1981 | Flautt, Jr. et al. | 219/728 |
| 4,703,148 | 10/1987 | Mikulski et al. | 219/10.55 E |
| 4,777,053 | 10/1988 | Tobelmann et al. | 426/107 |
| 4,870,233 | 9/1989 | McDonald et al. | 219/10.55 E |
| 5,300,746 | 4/1994 | Walters et al. | 219/745 |
| 5,391,430 | 2/1995 | Fabish et al. | 219/728 |
| 5,412,187 | 5/1995 | Walters et al. | 219/728 |
| 5,489,766 | 2/1996 | Walters et al. | 219/730 |

OTHER PUBLICATIONS

Articles titled: Better Susceptor Heats Up for Microwave Pizza and 'Printing' Metallized Patterns for Better Control pp. 102, 104, and 106, both from the Aug., 1995 issue of Packaging Digest.

*Primary Examiner*—Philip H. Leung
*Attorney, Agent, or Firm*—L. MeRoy Lillehaugen; John A. O'Toole; John Haurykiewicz

[57] ABSTRACT

A microwave container which morphs from a relatively microwave transparent condition to a relatively microwave blocking condition in response to microwave irradiation. The container wall section has a plurality of discrete, unconnected microwave reflective material elements initially permitting the transmission of microwave energy into the container and either a microwave absorptive material or a thermally responsive material active to coalesce the microwave reflective material elements into a connected array or pattern to block the transmission of microwave energy from entering the container after absorbing a predetermined amount of microwave energy.

22 Claims, 6 Drawing Sheets

MICROWAVE FOOD SCORCH SHIELDING

BACKGROUND OF THE INVENTION

This invention relates to the field of packaging materials for foodstuffs, specifically to the field of packaging foodstuffs for microwave irradiation. In the past, such packaging contained the foodstuff and may have included a susceptor for concentrating thermal energy for heating or cooking the food contained in the package. Such packages typically did not protect the foodstuff from overheating or overcooking, other than in certain embodiments, to reduce or eliminate the concentration caused by the susceptor or in the folds of such packaging. One typical example is microwave popping of popcorn, which is conventionally done in a paper bag carrying a susceptor. Once the popcorn is popped it has been found that it is easily scorched by continued exposure to microwave irradiation. The prior art has heretofore not addressed such continued exposure of the foodstuff to overlong microwave irradiation.

The present invention overcomes this deficiency of the prior art by providing a structure which is initially substantially transparent to microwave irradiation (allowing normal microwave heating and cooking). Upon reaching a predetermined temperature, the structure of the present invention morphs, or changes its own form, to a microwave shielding structure, preventing further heating or cooking (or scorching) of the foodstuff.

DETAILED DESCRIPTION OF THE INVENTION

Figure 1:
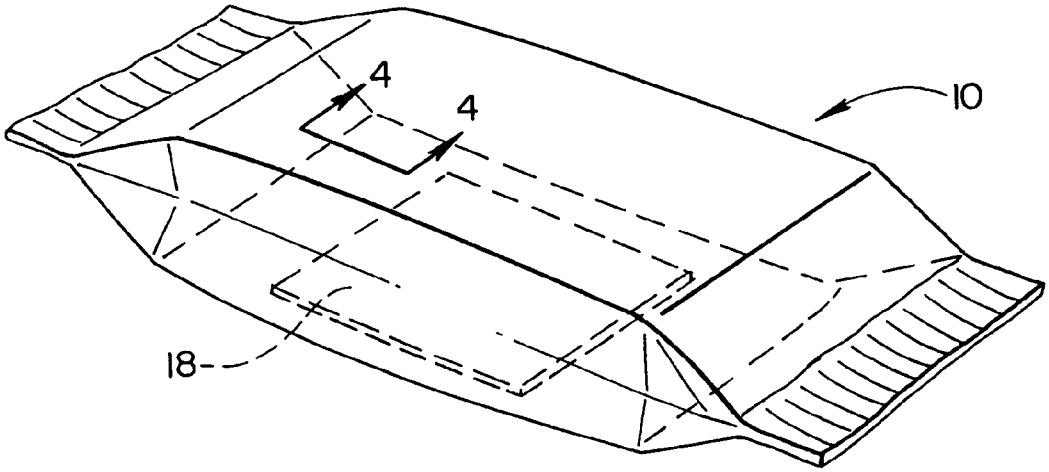
FIG. 1 is a perspective view of a microwave popcorn bag useful in the practice of the present invention.

Referring to the Figures, and most particularly to FIG. 1, a microwave-compatible food package in the form of a popcorn bag 10 which is useful in the practice of the present invention may be seen. Bag 10 is preferably a layered construction, having an inner layer 12, an outer layer 14 and a central layer 16. Inner and outer layers 12, 14 are each preferably formed of microwave transparent material such as paper or plastic. Central layer 16 is an interrupted pattern or dispersion of microwave reflective material, such as metal. One such pattern or arrangement may be seen in plan view in FIG. 2, and in more detail in side section view in FIG. 4. In addition to (and separate from) the structure for the present invention, bag or package 10 may have a conventional susceptor 18 attached thereto. It is to be understood that the structure of the central layer 16 may be utilized as other than a central layer while still remaining within the spirit and scope of the present invention; for example, the pattern of microwave reflective material described with respect to the central layer 16 may be positioned "off-center" in a laminated construction, or may be utilized as an outer layer, if desired.

Figure 2:
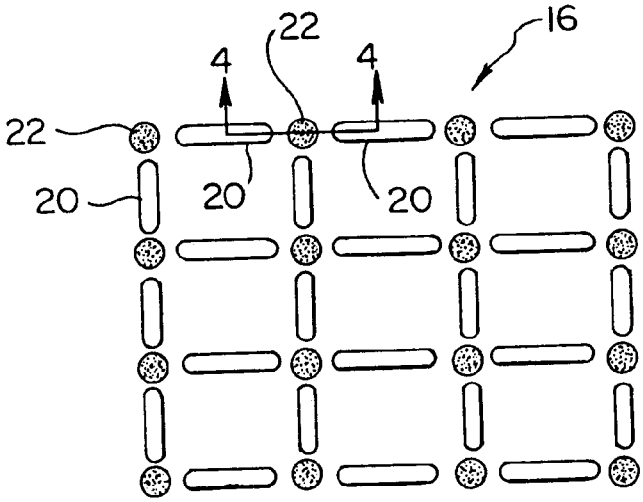
FIG. 2 is a detailed plan view of a structure useful in the practice of the present invention before being irradiated by microwave energy.
Figure 4:
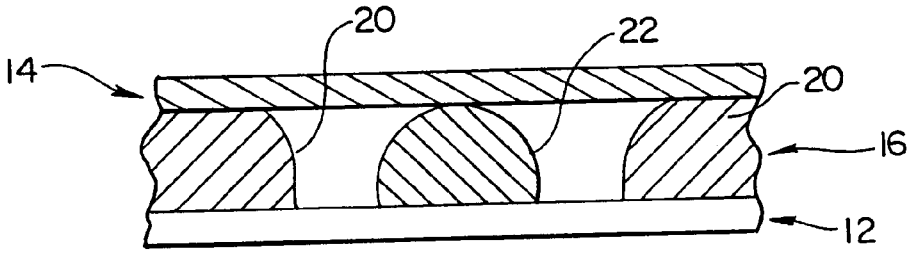
FIG. 4 is a side section view of a portion of the bag of FIG. 1 showing the structure of FIG. 2, taken along lines 4—4 in FIGS. 1 and 2.

As shown in FIGS. 2 and 4, in this embodiment the interrupted pattern of central layer 16 is preferably formed of spaced apart metallic elements 20, 22. Elements 20 may be printed conductive material such a plurality of spaced apart metal segments, which may be formed as dashes. Elements 22 are similarly spaced apart conductive segments, which may be formed as dots spaced between but not contacting the dashes 20. It is to be understood that the dashes are preferably of a material not affected by microwave irradiation, nor by the temperatures reached in the practice of the present invention, while the dots 22 are designed to be affected by such microwave irradiation, or more particularly, by the thermal effects of such irradiation on the foodstuff or package (or both).

The present invention provides a structure that is transparent to microwave irradiation during an initial period of exposure and then becomes reflective to the microwave energy after the predetermined exposure, thus shielding the contents of the bag or package from scorching or overheating upon the continued application of microwave energy.

Figure 3:
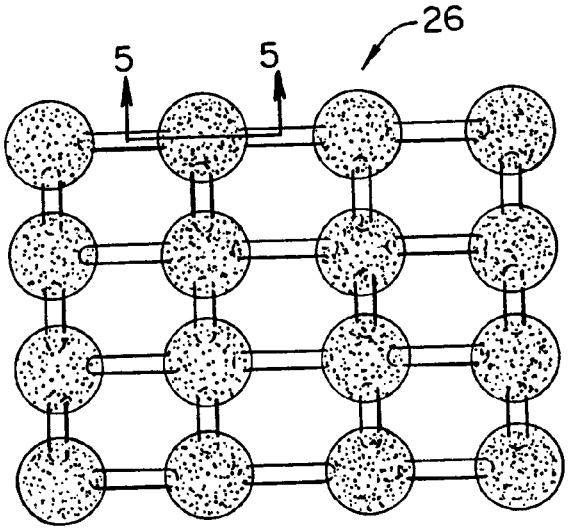
FIG. 3 is a detailed plan view of the structure of FIG. 2 after undergoing a transition in response to irradiation by microwave energy.
Figure 5:
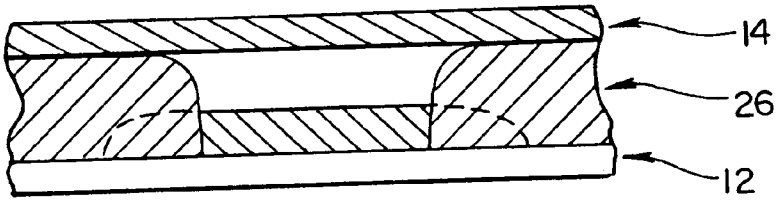
FIG. 5 is a side section view similar to that of FIG. 4, except showing the structure of FIG. 3.

In the embodiment shown in FIGS. 1–5, the dots 22 will melt upon the application of the predetermined microwave exposure raising the temperature to a predetermined melting point, upon which occurrence the elements 22 will contact the elements 20, forming an uninterrupted pattern to provide microwave shielding thereafter. FIGS. 3 and 5 show the post-irradiation (shielding) pattern. In practice, once the temperature of the central layer 16 exceeds a predetermined value, the dots 22 will undergo a phase change and electrically short out to adjacent elements 20, resulting in an uninterrupted pattern 26, as shown in FIGS. 3 and 5. As will become apparent with respect to other embodiments, the pattern can be regular or irregular or random, provided that initially it will permit passage of microwave energy (preferably without substantial impediment), and further provided that in its final, shielding state, it is substantially impermeable (preferably reflective) with respect to impinging microwave irradiation.

When the central layer becomes reflective, $$\theta=\delta^2/h\lambda<<1 \quad (1)$$

with the equivalent condition:

$$\sigma h>>3\times10^{20}\Omega^{-1} \quad (2)$$

where θ is a microwave interaction parameter, δ is the penetration depth of the electromagnetic field in the metallic central layer 26, h is the thickness of the metallic central layer 26, λ is the wavelength of the electromagnetic energy field, and σ is the conductivity of the metallic central layer 26.

In order to confirm that the pre-irradiation dimensions of the central layer 16 do not result in microwave screening, $$b>>4\pi\omega ha/c \quad (3)$$

where b is the gap between adjacent metallic elements 20, 22, ω is the radian frequency of the microwave field, h is the thickness and a is the width of the microwave elements 20, 22, and c is the speed of light ($3\times10^{10}$cm/s). It has been found that if b>>1 μm, the central layer (in its initial state) will not provide any substantial microwave screening at 2450 MHz. It is also to be understood that the length of each of the elements 20, 22 is to be much less than a quarter wavelength of the microwave frequency of interest. Here, with the microwave frequency at 2450 MHz, the wavelength is 12.25 cm.

The reflection and absorption coefficients (the ratios, respectively, of the reflected and absorbed energy to the incident energy) of an array of metallic particles of radius R each deposited on a plane surface with density n (per unit area) are:

$$\alpha_{ref}=nR^2(R/\lambda)^4K \quad (4)$$

(where K=0.026 for R<<δ, and K=0.002 for R>>δ), and $$\alpha_{abs}=(nR^2 3\delta)/2\lambda \text{ for } R>>\delta \quad (5a)$$

$$\alpha_{abs}=[(nR^2 3\delta)/2\lambda](2\pi R\delta/\lambda^2) \text{ for } R<<\delta \quad (5b)$$

For R=0.1 mm, δ=0.01 mm, and $nR^2$=0.01, $\alpha_{ref}\sim10^{-14}$ and $\alpha_{abs}10^{-4}$. (It is to be understood that the symbol ~ as used herein means "on the order of" or "in the range of".) Furthermore, a sheet made up of such particles so as to have a thickness $h=nR^3$ will have:

$$\alpha_{ref}=\begin{cases}1-\theta/\pi \text{ for } h<<\delta,\\ 1-\delta/4\pi\lambda \text{ for } h>>\delta\end{cases} \quad (6)$$

$$\alpha_{abs}=\begin{cases}\theta/\pi \text{ for } h<<\delta,\\ \delta/4\pi\lambda \text{ for } h>>\delta.\end{cases} \quad (7)$$

If $\alpha_{ref}$ is set to ≈0.999999 and $\alpha_{abs}$ is set to ≈0.00001 (the conditions of a relatively good reflector and bad susceptor) the restriction on particle radius is found to be R>1 micron. (It is to be understood that the symbol ≈ as used herein means "about".)

To prevent inter-particle arcing, it is assumed that the particles are ellipsoidal, each characterized by a long dimension a, and a short (transverse) dimension b. The linear dimension of the space between adjacent particles is d. The field between isolated and closely adjacent conductive ellipsoids is:

$$E\approx E_0(a/b)^2(1+b/d) \quad (8)$$

and when notice is taken that the dielectric strength for many materials is approximately $E_{ds}=10^7$ to $10^8$ V/m, and the electric field strength in conventional microwave ovens is of the order $E_0$=1KV/m, the condition of non-arcing is:

$$\max\{(a/b),(a/d)\}<(E_{ds}/E_0)^{1/2}=100. \quad (9)$$

In order to have the metallic particles follow the package temperature, it has been found desirable to make the particle radius R be much less than 1mm to avoid any significant time lag due to the thermal mass and consequent thermal inertia of the particle with respect to the overall package temperature. Of course, it may, in certain circumstances be found desirable to delay the transition to the shielding state, and in such occasions, the particle size may be increased to provide for such a delay.

Figure 6:
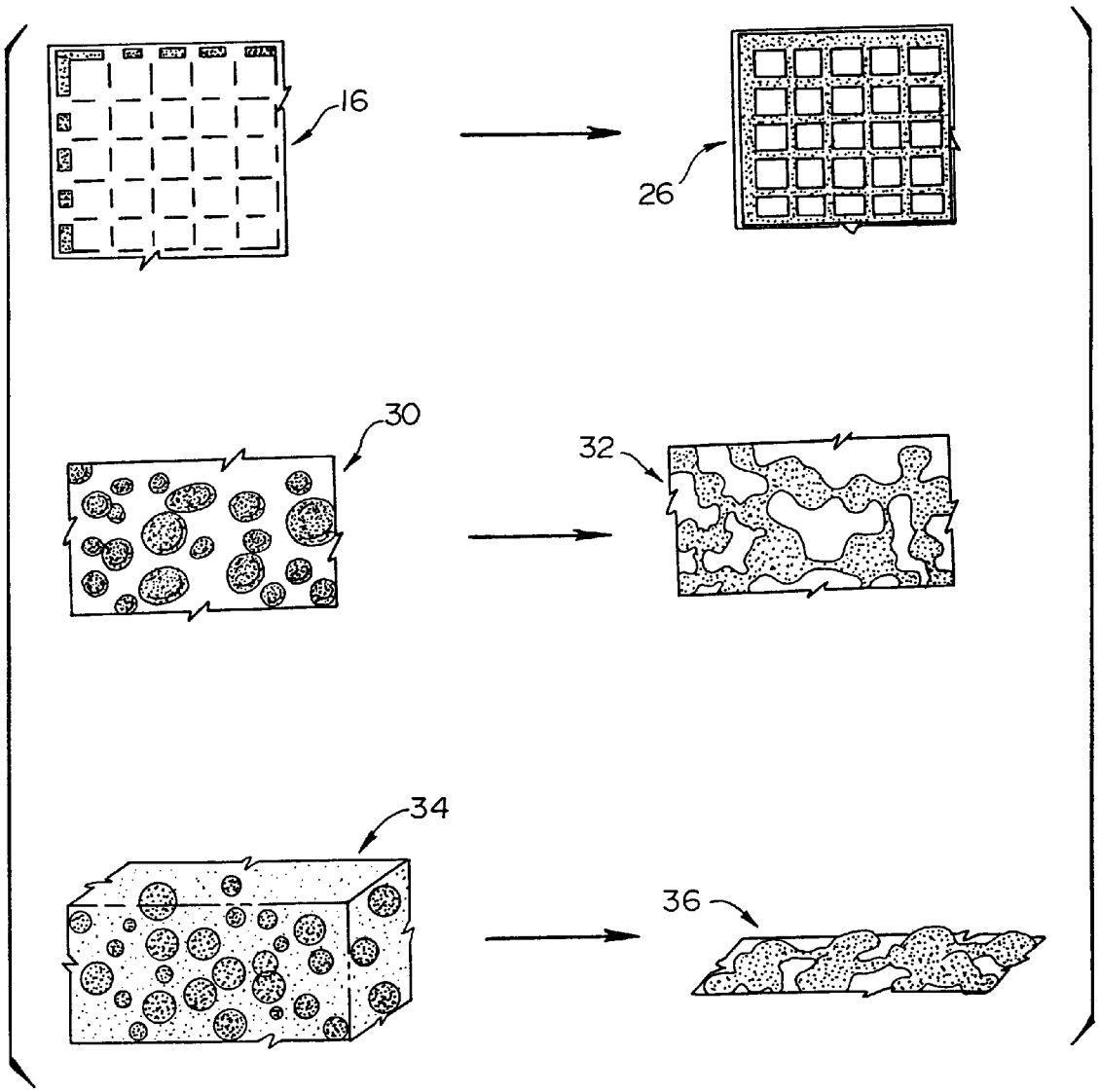
FIG. 6 is a composite view of various embodiments useful in the practice of the present invention in schematic simplified form both before and after microwave irradiation.

Referring now to FIG. 6, it is contemplated to be within the scope of the present invention to have a structure which morphs or changes its form from a microwave transparent (dielectric) phase to a microwave reflective (shielding) phase, illustrated by the method of connecting isolated segments to undergo the change as shown from form 16 to form 26, or to achieve the desired shielding result by melting discrete particles 30 to achieve a connected pattern 32, or to precipitate conductive particles from an isolated suspended state 34 to a conducting, precipitated state 36.

Figure 7:
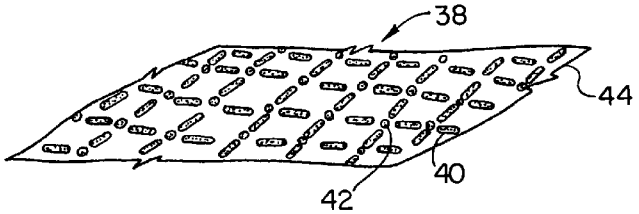
FIG. 7 is a perspective view of a paper layer having printed conductive material thereon, similar to FIGS. 2 and 4.
Figure 8:
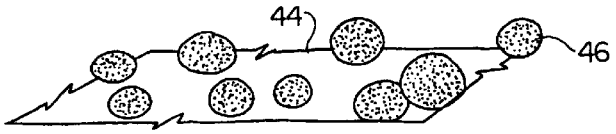
FIG. 8 is an alternative embodiment to that shown in FIG. 7, with powder coating material replacing the printed conductive material.
Figure 9:
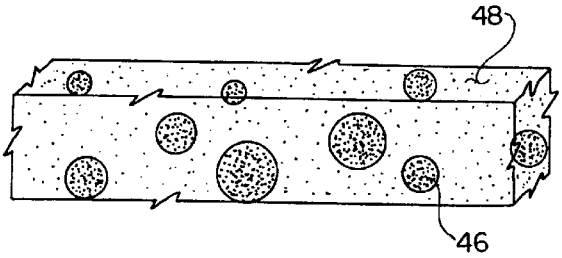
FIG. 9 is a further alternative embodiment to that shown in FIGS. 7 and 8 with conductive material particles suspended in an insulating solvent.
Figure 10A:
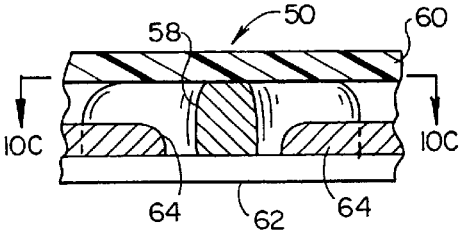
FIGS. 10A. 10B, 10C, and 10D are composite views of a solder dot embodiment of the present invention showing side and top section views of a microcircuit before and after microwave irradiation.
Figure 10B:
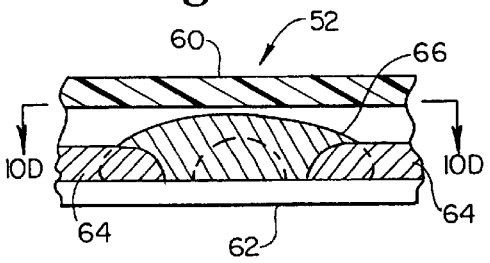
Figure 10C:
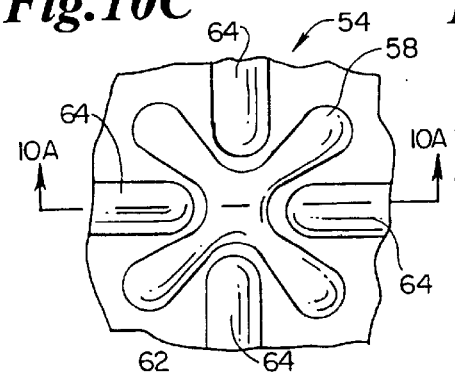
Figure 10D:
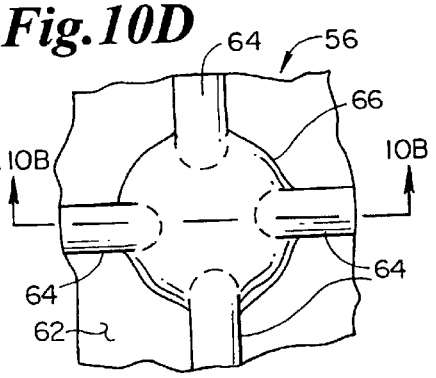

Various embodiments of the central layer 16 may be seen in FIGS. 7, 8 and 9. In FIG. 7, a printed microcircuit 38 having non-microwave reactive particles 40 and solder dots 42 is secured to a paper substrate or layer 44. In FIG. 8, conducting particles 46 (made, for example, of metal) are applied to a substrate 44 by powder coating. In FIG. 9, metal or other conducting particles 46 are held in suspension by an insulating solvent 48, such as a resin or volatile material capable of being driven off by heat. It is to be understood that, as shown, the particles in FIGS. 8 and 9 are considerably magnified from the scale of the particles 40 in FIG. 7.

Referring now to FIG. 10, a non wetting embodiment of the microcircuit 38 may be seen. In this Figure, side section views 50, 52 are taken along lines B—B and D—D, respectively, and top section views 54, 56 are taken along lines A—A and C—C, respectively. It is to be understood that views 50 and 54 are before microwave irradiation, and views 52 and 56 are as the microcircuit appears after microwave irradiation. This embodiment utilizes a "lobed" solder form 58 located between a protective layer 60 (such as plastic) and a substrate 62 (such as paper). Microcircuit elements 64 are spaced apart from solder element 58 before irradiation, as can be seen in views 50 and 54. At this time, elements 64 and 58 do not significantly block microwaves from penetrating the composite packaging made up of protective layer 60, microcircuit elements 58 and 64, and substrate 62. As the embodiment shown in views 50 and 54 is heated, the solder will change shape to that shown in FIGS. 52 and 56, effectively forming a microwave-shielding microcircuit because of the "relaxation" of the solder element to the shape 66. The characteristic reshaping time is determined by the viscous flow in response to surface tension once the solder material liquifies. The reshaping time, $\tau_r$, can be estimated as:

$$\tau_r\approx\eta R^2/\gamma h \quad (10)$$

where $\eta$ is the viscosity, and $\gamma$ is the surface tension. (It is to be understood that the symbol $\approx$ as used herein means "approximately equal to" with, for example, a scale factor omitted.) For R=0.1 cm and h=0.01 cm, $\tau_r$ can be as short as one second. Care must also be taken to avoid perforation or penetration of the protective layer and the paper substrate due to the solder tendency to assume a spherical shape. Assuming the contact angle $\phi$ is small (typical for unwetting surfaces) the estimate $$p \approx (4\gamma\cos\phi)/h \tag{11}$$

gives $p=10^4$ to $10^5$ dyne/cm$^2$ which is considerably less than a typical ultimate paper strength of about $10^{10}$ dyne/cm$^2$.

In the microcircuit embodiment, it is to be understood that the melting of solder dots 42 must occur before the food has an opportunity to burn or scorch. Furthermore, even unwetting metallic elements 40 can be utilized with dots or other shapes formed of solder, such as are illustrated in FIGS. 10A, 10B, 10C, and 10D.

Figure 11:
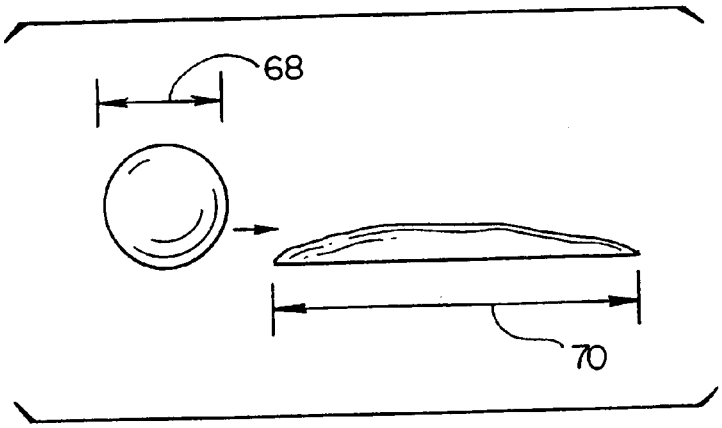
FIG. 11 is a simplified side view illustrating particle spreading.
Figure 12:
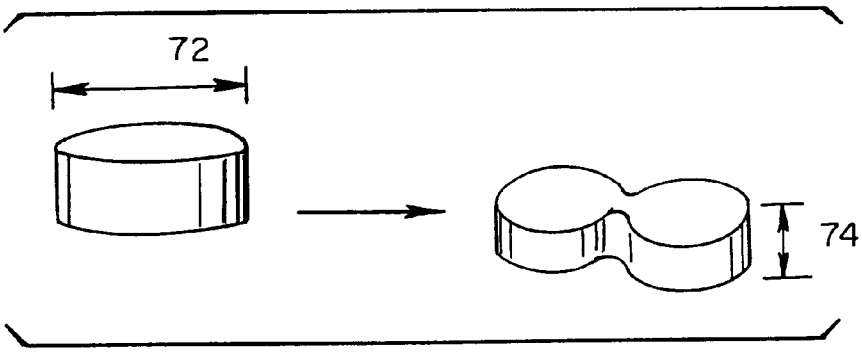
FIG. 12 is a simplified perspective view illustrating particles coalescing.
Figure 13:
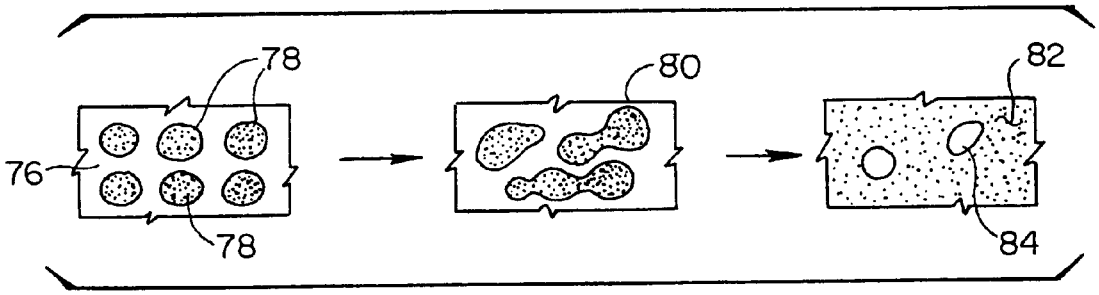
FIG. 13 is a top plan view of the effect of particle spreading and coalescence.

In connection with using powder coating to form the switchable microwave shielding layer, the processes of powder particle spreading and coalescence are to be considered. Referring to FIG. 11, particle spreading is illustrated graphically with a single particle of an initial radius 68 $R_0$ and a final spread length 70 R, where the spreading time, $\tau_s$, can be estimated by:

$$\tau_s \approx (\nu R/\Delta\gamma)(R/R_0)^3 \approx (10^{-3}\sim 10^{-5})\ (R/R_0)^3 \text{sec} \tag{12}$$

where $\Delta\gamma$ is the wetting energy (of the same order of magnitude as the surface energy). The coalescence time, $\tau_c$, can similarly be estimated as:

$$\tau_c \approx \eta R^2/h\gamma \approx (10^{-3}\sim 10^{-5})\ (R/h)\text{sec} \tag{13}$$

where R is the initial radius 72 and h is the thickness 74. Thus it may be seen that each of the spreading time and coalescence time can be considerably smaller than 1 second. A macroscopic top plan view of the phenomena of spreading and coalescence is shown in FIG. 13, where a layer of paper 76 is initially coated with discrete metal particles 78 using a conventional powder coating process. Spreading of the particles 78 is illustrated at 80, with eventual coalescence into a relatively continuous metal sheet 82 (which may have some apertures 84 remaining). As is well known, the apertures will not adversely affect shielding, provided that the dimensions of each aperture are much less than a wavelength of the applied microwave field.

Figure 14:
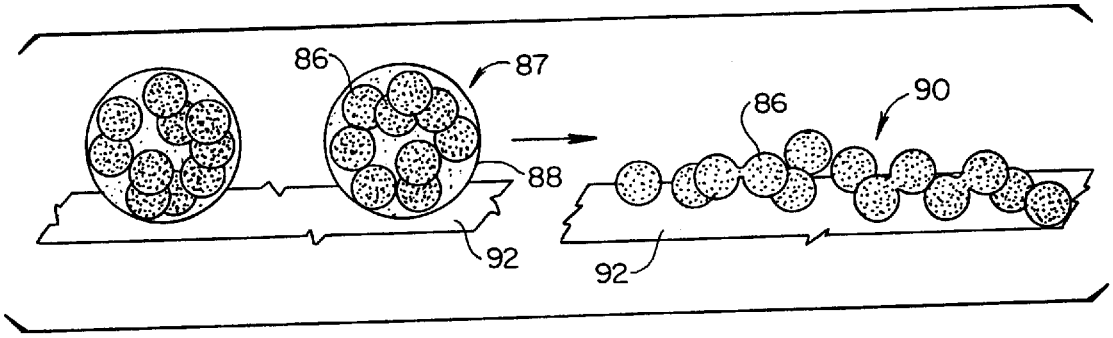
FIG. 14 is a is a simplified side view of a composite powder coating showing a composite material made up of metal and flux before and after microwave irradiation.

In addition to powder coating using all metal particles, it is to be understood to be within the scope of the present invention to use a composite powder coating technology such as illustrated in FIG. 14, with metal particles 86 embedded in organic flux 88 (such as epoxy resin) to form composite particles 89 having a desired melting temperature to achieve a shielding structure 90 formed of contacting metal particles on substrate 92. In this embodiment, the metal particles 86 may remain intact or may, alternatively, melt to form a relatively continuous sheet 82 such as shown in FIG. 13. In the practice of powder coating the layer to serve as a microwave shield, tin based powders may be used with particle radii about 10 mm and with a melting temperature in the range of 40 to 316° C. Alternatively, sintering metal powders may be used to form a conducting (shielding) layer.

Figure 15:
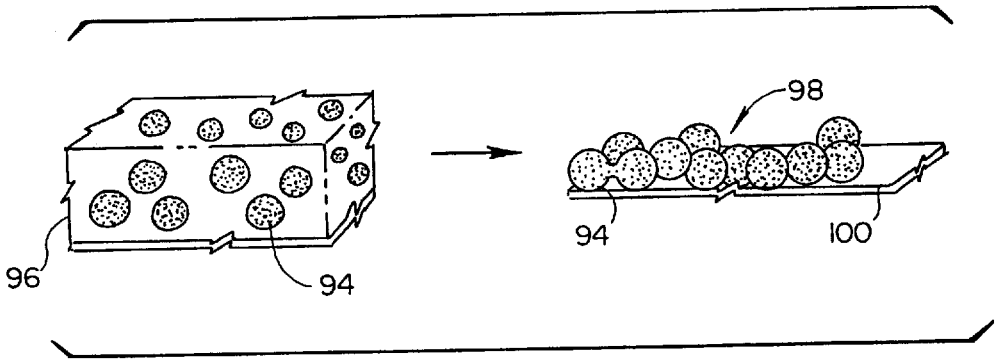
FIG. 15 is a perspective view of the embodiment of FIG. 9 before and after microwave irradiation.
Figure 16:
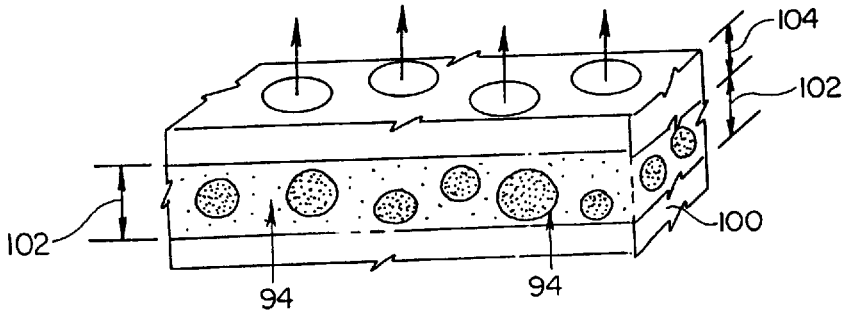
FIG. 16 is a perspective view of the embodiment of FIG. 9 illustrating certain aspects of the present invention.

Referring now to FIGS. 15 and 16, still another approach is to use metal particles 94 dispersed and suspended in a solvent-containing coating 96. Coating 96 is to be understood to be physically stable at conventional storage and room temperatures and is capable of being volatilized at a desired predetermined elevated temperature. The initial volume fraction of metal particles to the total volume is preferably less than about 10 percent. As the solvent is purposely evaporated, the volume fraction of metal particles rises, and a microwave shielding structure 98 is formed on substrate 100 as the metal particles 94 come into contact with each other. The characteristic solvent evaporation time, $\tau_c$, depends on both the solvent material parameters and the paper porosity:

$$\tau_c = l_0/[na^3\nu\alpha(1+l_p na^2)] \tag{14}$$

where n is the concentration of saturated vapor, $\nu$ is the molecular velocity, a is the molecular radius, $\alpha$ is the paper porosity, $l_0$ is the solvent layer thickness 102, and $\mathbf{1}_p$ is the covering paper (protective layer) thickness 104.

The invention is not to be taken as limited to all of the details thereof as modifications and variations thereof may be made without departing from the spirit or scope of the invention.

What is claimed is:

1. Apparatus for shielding foodstuffs from scorching in a microwave field comprising:

a) a generally microwave transparent base material forming a generally enclosing container for foodstuffs:

b) an energy reactive material located on the base material and having:

i) an initial configuration of a plurality of discrete, separated elements of microwave reflective material individually sized and sufficiently spaced apart to allow transmission of microwave energy into the container to heat foodstuffs located within the container; and ii) a final configuration wherein a substantial majority of the discrete, separated elements come into contact with each other to form a continuously extending arrangement substantially blocking transmission of microwave energy into the container to prevent scorching of the foodstuff wherein the energy reactive material undergoes a transition from the initial configuration to the final configuration after a predetermined exposure to the microwave energy.

2. The apparatus of claim 1 wherein the transition is a phase change of the energy reactive material.

3. The apparatus of claim 1 wherein the energy reactive material is a carrier with microwave reflective material initially dispersed therein and the transition acts on the carrier to cause the microwave reflective material to form a generally microwave reflective layer.

4. The apparatus of claim 1 further comprising c) an interrupted pattern of microwave reflective elements having interstices therebetween; and wherein the energy reactive material comprises elements located in the interstices between the elements of the interrupted pattern of microwave reflective material and initially spaced apart therefrom and further wherein the transition to the final configuration occurs upon the energy reactive elements in the interstices connecting interruptions in the pattern of the microwave reflective material such that the pattern becomes substantially uninterrupted and wherein the pattern is sized in the final configuration to substantially block the passage of microwave energy therethrough to prevent scorching thereafter.

5. The apparatus of claim 1 wherein the predetermined exposure to microwave energy corresponds to a predetermined temperature.

6. The apparatus of claim 1 wherein the energy reactive material reacts to the microwave energy directly.

7. The apparatus of claim 1 wherein the energy reactive material reacts at a predetermined elevated temperature resulting from the predetermined exposure to microwave energy.

8. Apparatus for shielding foodstuffs from scorching in a microwave field comprising:

a) a generally microwave transparent base material forming a generally enclosing container for foodstuffs;

b) a thermally reactive material located on the base material and having:

i) an initial configuration of a plurality of discrete, separated elements of microwave reflective material individually sized and sufficiently spaced apart to allow transmission of microwave energy into the container to heat foodstuffs located within the container; and ii) a final configuration wherein a substantial majority of the discrete, separated elements come into contact with each other to form a continuously extending arrangement substantially blocking transmission of microwave energy into the container to prevent scorching of the foodstuff wherein the thermally reactive material undergoes a transition from the initial configuration to the final configuration upon reaching a predetermined temperature.

9. The apparatus of claim 8 wherein the thermally reactive material is metal.

10. The apparatus of claim 9 wherein the metal at least partially melts to form the final configuration.

11. The apparatus of claim 8 wherein the thermally reactive material is a carrier containing metal particles.

12. The apparatus of claim 11 wherein the thermally reactive material is a solvent.

13. The apparatus of claim 12 wherein the metal particles precipitate to form the final configuration.

14. The apparatus of claim 8 wherein the thermally reactive material further comprises metal particles which at least touch each other to form the final configuration.

15. The apparatus of claim 8 wherein the thermally reactive material is powder coated on the base material.

16. A method of shielding foodstuffs from scorching in a microwave field comprising the steps of:

a) forming a generally enclosing container of a generally microwave transparent material for containing foodstuffs;

b) forming an energy reactive material layer on the base material in an initial configuration of a plurality of discrete, separated elements of microwave reflective material individually sized and sufficiently spaced apart to allow transmission of microwave energy into the container to heat foodstuffs located within the container; and c) applying microwave energy to the container such that the energy reactive material morphs to a final configuration wherein a substantial majority of the discrete, separated elements come into contact with each other to form a continuously extending arrangement substantially blocking transmission of microwave energy into the container to prevent scorching of the foodstuffs within the container upon the energy reactive layer receiving a predetermined exposure to the microwave energy.

17. The method of claim 16 wherein the energy reactive layer is applied to the base layer by printing a microcircuit thereon.

18. The method of claim 17 wherein the microcircuit contains elements reactive to an elevated temperature to complete the microcircuit and form a microwave shielding layer.

19. The method of claim 16 wherein the energy reactive layer is applied to the base layer by powder coating.

20. The method of claim 19 wherein the powder coating includes microwave reflective particles dispersed and generally unconnected in the initial configuration and further wherein the microwave reflective particles join together in the final configuration to form a microwave shielding layer.

21. The method of claim 16 wherein the energy reactive layer is a solvent containing dispersed and generally unconnected microwave reflective particles.

22. The method of claim 21 wherein the solvent is evaporated in step c), causing the microwave reflective particles to precipitate and form a microwave shielding layer.

* * * * *